US005586418A

United States Patent [19]

Ålander et al.

[11] Patent Number: 5,586,418

[45] Date of Patent: Dec. 24, 1996

[54] COMPOSITE CONSTRUCTION OF REINFORCED CONCRETE

[75] Inventors: Casper Ålander; Tarmo Mononen, both of Espoo, Finland

[73] Assignee: Rautaruukki Oy, Hameenlinna, Finland

[21] Appl. No.: 362,423

[22] PCT Filed: Jun. 30, 1993

[86] PCT No.: PCT/FI93/00276

§ 371 Date: Jan. 30, 1995

§ 102(e) Date: Jan. 30, 1995

[87] PCT Pub. No.: WO94/01636

PCT Pub. Date: Jan. 20, 1994

[30] Foreign Application Priority Data

Jul. 1, 1992 [FI] Finland ..... 923052

[51] Int. Cl.[6] ..... E04F 13/12

[52] U.S. Cl. ..... 52/450; 52/260; 52/334

[58] Field of Search ..... 52/260, 334, 443, 52/450, 453, 319, 327, 337

[56] References Cited

U.S. PATENT DOCUMENTS

| | | | |
|---|---|---|---|
| 2,006,070 | 1/1934 | Di Stasio . | |
| 3,397,497 | 8/1968 | Shea et al. | 52/450 X |
| 3,812,636 | 5/1974 | Albrecht et al. | 52/334 |
| 4,211,045 | 7/1980 | Koizumi et al. | 52/260 X |
| 4,333,285 | 6/1982 | Koizumi et al. | 52/252 |
| 5,050,358 | 9/1991 | Vladislavic | 52/334 |

FOREIGN PATENT DOCUMENTS

| | | | |
|---|---|---|---|
| B-12-358/88 | 2/1987 | Australia . | |
| 0240857 | 10/1987 | European Pat. Off. . | |
| 76401 | 5/1986 | Finland . | |
| 84847 | 10/1990 | Finland . | |
| 434648 | 10/1967 | Switzerland | 52/334 |

OTHER PUBLICATIONS

Official Action in corresponding Polish patent application No. P 306852.

Copy of International Preliminary Examination Report.

*Primary Examiner*—Carl D. Friedman
*Assistant Examiner*—Yvonne Horton-Richardson
*Attorney, Agent, or Firm*—Tilton, Fallon, Lungmust & Chestnut

[57] ABSTRACT

A composite construction which has a beam part (1) and a slab part (2) bearing thereon, the construction comprising the following components: a) a metal mantle (3) of the beam part, the mantle being at the same time the casting form and being made up of an upwardly open profile; b) additional reinforcement components (7) which, together with the metal mantle, make up the reinforcement of the composite construction; and c) a cast component (8) which, when set and together with the metal mantle and with the additional reinforcement components left inside the casting, makes up the composite construction. The metal mantle (3) of the beam part (1) is a shaped profile the inner surface (10) of which has an embossed pattern. The cross-sectional shape of the wall form (3) of the beam part is defined by sheet portions (12) interconnected by outwardly or inwardly oriented edgings (13), corrugations or welded joints, or by curved sheet portions which are oriented away from the longitudinal surfaces (5) in the vertical plane or from it towards the center line (14) of the beam.

11 Claims, 3 Drawing Sheets

Fig.4A
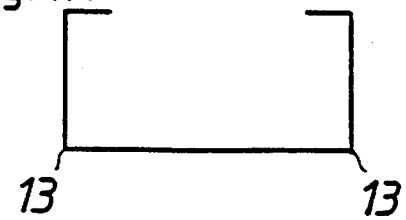
Fig.4H
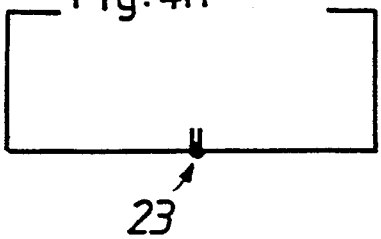
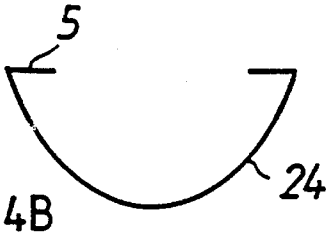
Fig.4B
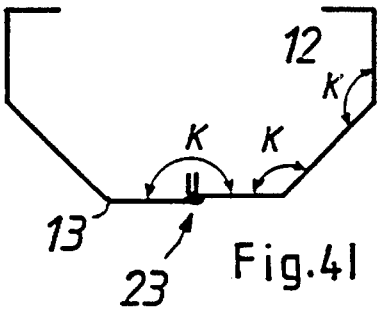
Fig.4I
Fig.4C
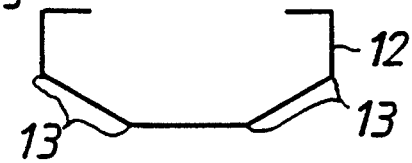
Fig.4D
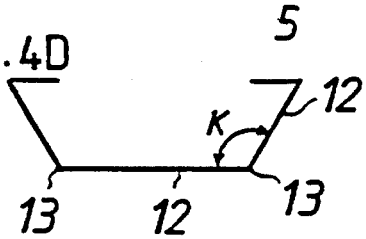
Fig.4L
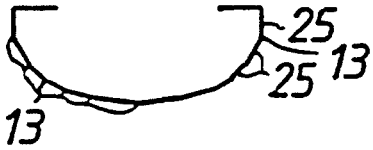
Fig.4E
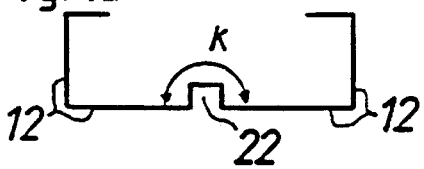
Fig.4J
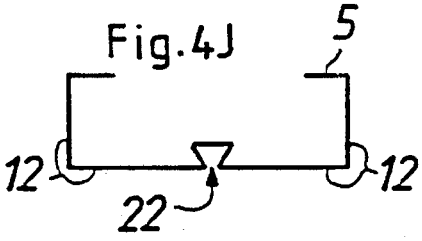
Fig.4F
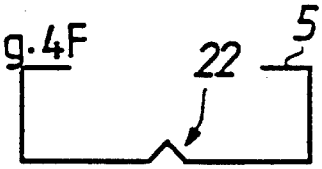
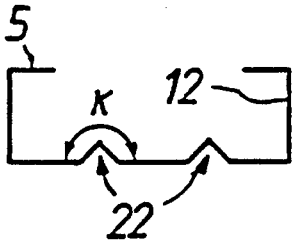
Fig.4K
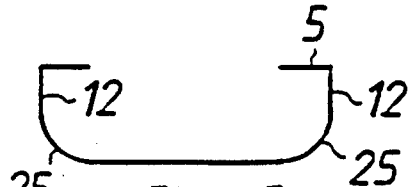
Fig.4G

COMPOSITE CONSTRUCTION OF REINFORCED CONCRETE

The invention relates to a composite construction having a beam part and, bearing thereon, a slab part, the construction comprising a combination of at least the following components:

a) a metal mantle of the beam part, the mantle being at the same time the casting form and being made up of an upwardly open profile which has longitudinal surfaces and a portion between them;

b) additional reinforcement components which, together with the metal mantle, make up the reinforcement of the composite construction; and c) a cast component, such as concrete, which, when set and together with the metal mantle and with the additional reinforcement components left inside the cast component, makes up the composite construction.

This application relates to a composite construction of steel and a concrete material, in which the bond between the concrete and the steel is sufficient to ensure that these two materials having different properties will act together. As such, traditional reinforced concrete is a composite construction, but according to present-day practice, by a composite construction is understood a combination of steel components or thin sheet components and of concrete or reinforced concrete. Justification for the use of composite constructions is found in advantages which are both structural and derived from the construction method; if correctly exploited, these advantages provide cost efficiency as compared with more conventional steel or reinforced concrete constructions. In terms of cost efficiency it is to be noted that one of the most advantageous methods of reinforcing concrete is to use reinforcement made of reinforcement steel. The price per kilogram of an installed steel sheet or thin sheet structure is in general higher than that of installed reinforcement bars. Furthermore, the strength level of reinforcement bars is higher than that of the steel sheet products used in construction. Mere replacing of the reinforcement bars with other steel profiles is thus in itself not a sensible objective. On the other hand, when the steel structure serves as a casting form which will remain in place, and serves at the same time as part of the reinforcement, it is possible to obtain an advantageous end result.

Several composite constructions of this type have been presented. Finnish patent publication 63465 discloses a system in which the entire lower surface of a cast intermediate floor consists of a continuous thin metal sheet, which thus serves as both the form and as a reinforcing component for the completed construction. Since in this the metal sheet constitutes the most essential component of the reinforcement, the construction is not safe in a fire situation, since the base made up of metal sheet will in this case be exposed to fire. Furthermore, in this construction the metal sheet which makes up the form tends, under load, to become detached from the concrete, whereby its reinforcing effect is lost. The publication does not describe any mechanism ensuring the bond between the metal sheet and the concrete.

Finnish patent 76401 describes a composite construction beam part from the lower surface of which there projects a bonding mechanism for bonding with the concrete. However, the manufacture of the bonding mechanism described in the publication is a relatively complicated work step. The surface of the metal mantle itself has not been made use of in producing the bonding, required by the composite effect, between the concrete and the steel component, and the shape of the profile is not such as to prevent the mantle from becoming detached from the concrete. Furthermore, the system is such that the construction cannot conveniently be made to continue over supports. Thus the arrangement described is in practice applicable only to relatively narrow and high beam parts, which limits the uses of the construction. Furthermore, the reinforcement system in the publication is such that it is interrupted in the area of a vertical column arranged in the area of the beam part, in which case such areas require special steps to be taken, not disclosed.

The object of the present invention is to provide a composite construction in which the bonding, presupposed by the composite effect, between the concrete and the metal mantle is substantially implemented by the selection of the pattern of the inner surface of the mantle and the correct shape of the mantle profile, without the need for any other special steps. Another object of the invention is to provide a construction which, after the setting of the cast component, will be continuous and joint-free owing to the additional reinforcements surrounding the cast component, without any cost-increasing jointing techniques associated with a metal mantle. According to this principle, the mere concrete component and additional reinforcement components contribute most of the shear resistance of the construction and of its ability to receive any support reactions to which the construction is subjected. One further object of the invention is a composite construction made up of simple, industrially manufactured, relatively light metal components which are easy to install on site. In the casting situation the metal mantle is in the same position as it will be in the completed construction, in which case, in on-site casting, the beam and the slab can be conveniently cast in the same work step. Functionally the effective width of the construction extends to the area of the slab.

The above disadvantages can be eliminated and the objects defined above can be achieved by using the composite construction according to the present invention, the construction being characterized in what is stated in the characterizing clause of Claim 1.

The most important advantage of the invention is that the shape and construction of the beam part are such that a profile made up of the metal mantle will not, under load, buckle and be detached from the concrete component of the beam. It is a further substantial advantage of the invention that the metal mantle of the beam part, being a simple industrially manufactured profile, as such constitutes a nearly completed component for composite construction, in which case its manufacturing costs are substantially lower than those of other known steel components for composite construction. A second advantage of the invention is that the construction will be resistant in a fire situation, without the need for any special measures. A third advantage of the invention is that pre-cambering is easy to apply, since the mantle profile alone is not very rigid in the vertical direction. Pre-cambering can be done either by lifting by using the shoring during casting or by making the profile curved on the production line. After the setting of the concrete the construction is very rigid, although it takes very little vertical space. Owing to the pre-cambering and the rigidity, the construction is competitive also when the spans are long. A further advantage of the invention is that the construction, including its beam parts and slab parts and possibly adjoining columns, is throughout continuous and joint-free, thus being of top quality.

The invention is described below in detail with reference to the accompanying drawings.

FIGS. 4A–L depict various cross-sectional shapes of the beam part of the composite construction according to the invention.

Figure 1:
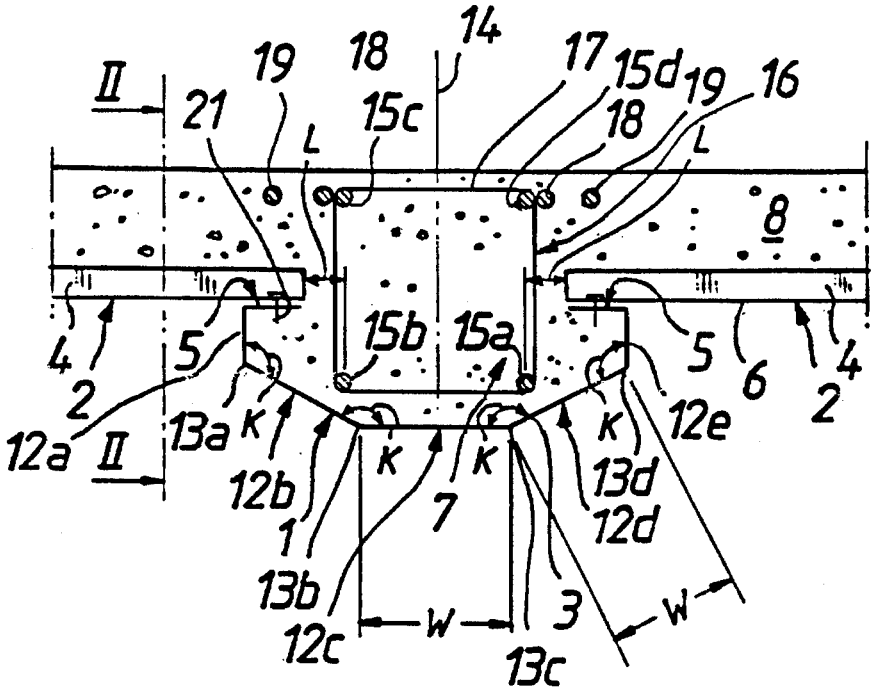
FIG. 1 depicts a composite construction according to the invention, in cross section relative to the length of the beam part, through the plane I—I in FIG. 2.
Figure 2:
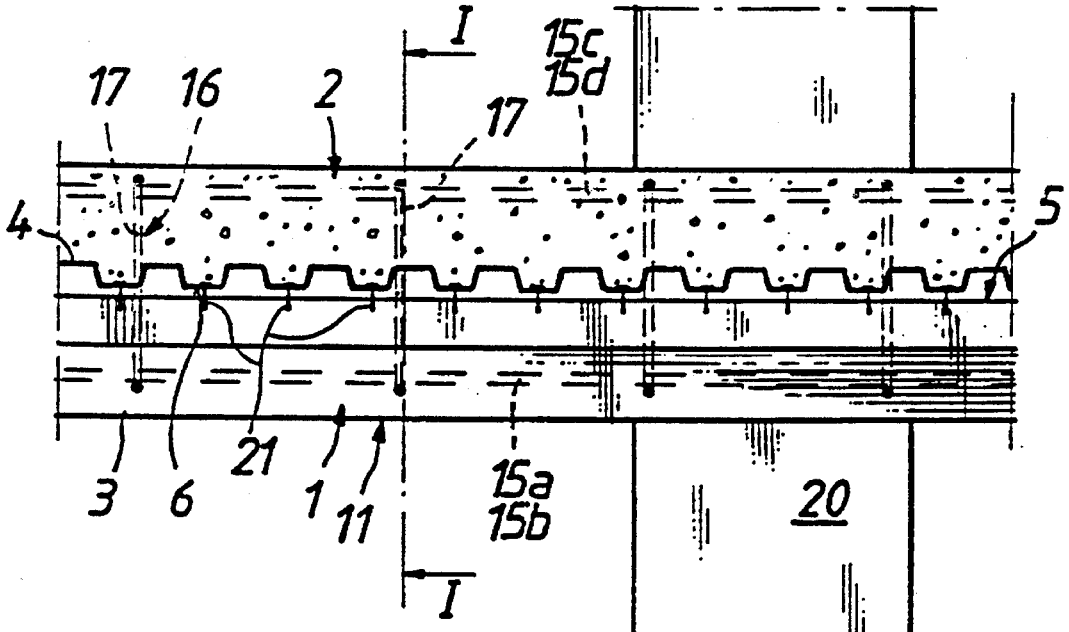
FIG. 2 depicts a composite construction according to the invention, in a longitudinal section through the plane II—II in FIG. 1.
Figure 3A:
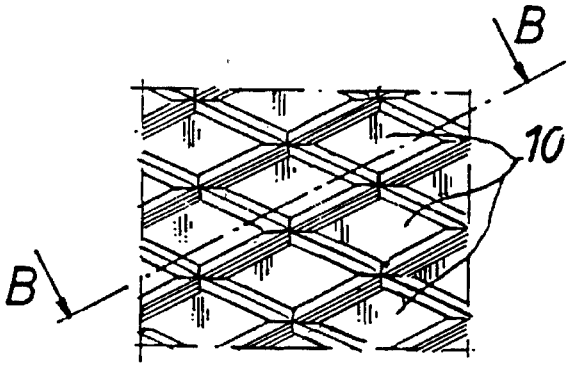
FIGS. 3A and 3C depict two different surface patterns of the metal sheet to be used in the beam part of the composite construction, as seen from directions A and C in FIGS. 3B and 3D.
Figure 3B:
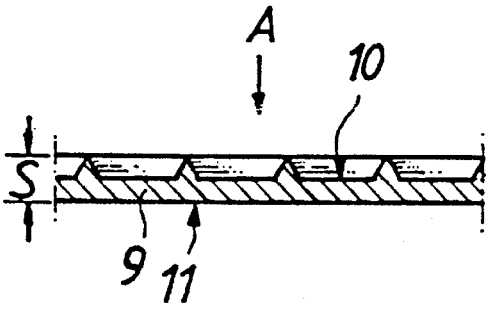
FIGS. 3B and 3D depict cross sections of the metal sheets of FIGS. 3A and 3C, through the planes B—B and respectively D—D.
Figure 3C:
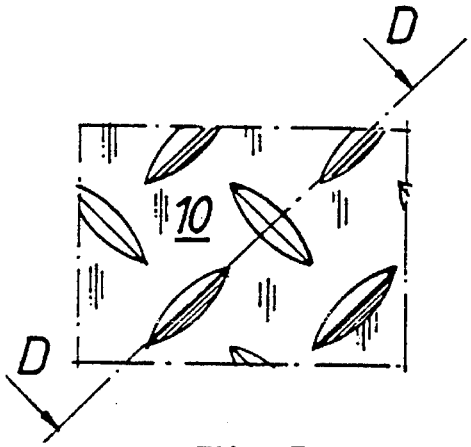
Figure 3D:
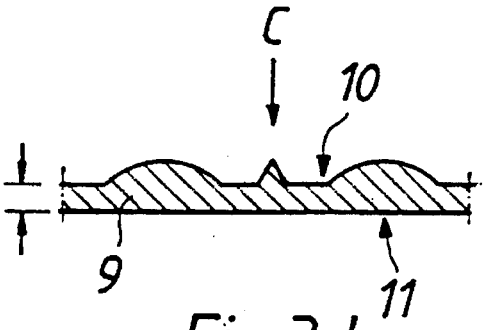

FIGS. 1 and 2 depict a composite construction comprising a beam part 1 and a slab part 2 bearing thereon. The composite construction in this case thus includes at least the following components as a combination. The beam part 1 is made up of a metal mantle 3, which has been shaped as an upwardly open sheet profile having continuous longitudinal surfaces 5 for fastening a composite sheet or other such slab form. After the setting of the concrete, the support reaction of the slab is transferred substantially by mediation of the concrete to the beam and not via the lower surface 6 of the bottom form 4 of the slab part. From these longitudinal surfaces 5 and the slab part there extend towards each other sheet portions 12, which may, in the manner shown in the figures, be straight portions, curved portions 25, or alternatively be made up of a mere underside rounding 24 of the longitudinal surfaces 5. The slab part 2, to which the invention does not actually relate, is in this case made up of a bottom form 4, which is formed from profiled sheet or sheets, a flat sheet, or corresponding elements. In addition, the composite construction includes additional reinforcement components 7 which, together with the said metal mantle 3 and the bottom form 4, make up the reinforcement of the composite construction. The composite construction also includes a cast component 8, such as concrete or some other mix, which sets and thereby, together with the said forms 3 and 4 and with the additional reinforcement components 7 left inside the cast, makes up the final composite construction.

According to the invention, the metal mantle 3 of the beam part 1 is made up of a metal sheet 9 the surface 10 of which, facing the inside of the beam, has an embossed pattern, for example in the manner shown in FIGS. 3A–D. The embossing may be a flute pattern, shown in FIGS. 3A and 3B, or a tear drop pattern, shown in FIGS. 3C and 3D, which are embossing patterns known per se. Also, the metal sheet 9 is of such a thickness that the embossing does not substantially affect the quality of the surface of the opposite side 11 of the sheet 9. In this case the thickness S of the material is in an order of approximately 4–8 mm and typically in the order of 6 mm. In addition, the cross-sectional shape of the metal mantle 3 of the beam part in the area between the longitudinal surfaces 5 of the beam is defined by two or more sheet portions 12*a*–12*e* which constitute extensions of the side surfaces and are mutually at an angle K. The angles K between these sheet portions 12*a*–12*b*, 12*b*–12*c*, 12*c*–12*d*, etc., are substantially greater than 90° and substantially smaller than 180°. By this construction the cross-sectional portion of the metal mantle between the longitudinal surfaces can be made to comprise a number of sheet portions 12*a*–12*e* which are at angles relative to each other, in which case the edges 13 formed by the angles K stiffen the metal mantle 3. Such cross-sectional shapes are shown in FIGS. 4C–D.

Another alternative is to use sheet portions 12 to combine corrugations 22 oriented towards the inside of the beam part, as shown in FIGS. 4E, F, J, and K. A corrugation 22 may be triangular, angular, curved, or dovetail-shaped. The corrugations may also be oriented outwards from the beam part 1, in a manner not shown in the figures. A third alternative is to use welded joints 23 to connect the sheet portions 12. The welded joints 23 can advantageously be formed as butt joints between edgings oriented towards the inside of the beam part, the joints being welded, for example, from the outside, as shown in FIGS. 4H–J. A fourth alternative is to use one curved portion 24, as in FIG. 4B, or a plurality of curved portions 25, which connect straight sheet portions 12, as in FIG. 4G, or which are connected, for example, by edges 13, as in FIG. 4L.

Thus the cross-sectional shape in any given case, the moderately large thickness of the metal sheet 9, and the surface pattern of the inner surface 10 all promote the bonding of the sheet to the cast component 8, such as concrete. Especially the cross-sectional shape, together with the sheet 9 thickness, prevents the sheet portions 12*a*–12*e* or 24, 25 from becoming detached outwardly under the effect of the tensile stress of the lower surface of the beam. Preferably there are at least three sheet portions, as shown in FIG. 1, but their number may also be considerably higher. The widths W of the different sheet portions 12 are preferably also approximately equal, as are the angles K between the sheet portions. The edge between the longitudinal surfaces 5 and the extreme sheet portions 12*a* and 12*e* or sheet portions 24 or 25 may be substantially rounded or relatively sharp. Part of the bending strength of the construction and most of its resistance to shear and torsion depend on the additional reinforcement 7 and the reinforced concrete made up of the cast component, this reinforced concrete having been cast into the space formed by the metal mantle 3. The metal mantle itself has no substantial resistance to shear and torsion.

In accordance with the invention, the continuous longitudinal surfaces 5 of the beam part i are oriented from the extreme sheet portions 12*a* and 12*e* towards each other, i.e. towards the center line 14 of the beam. The beam part 1 has a reinforcement element 16 or reinforcement elements, which consist of longitudinal reinforcement bars 15*a*, 15*b*, 15*c*, 15*d*, and of these the lowest longitudinal reinforcement bars 15*a* and 15*b* are located at a level below the longitudinal surfaces 5. Typically the additional reinforcement components 7 thus comprise a plurality of reinforcement bars 15*a*–15*d* parallel to the longitudinal direction of the beam part, the bars being preferably tied to each other with ties 17 to form reinforcement elements 16. Preferably the upper longitudinal reinforcement bars 15*c* and 15*d* of the reinforcement elements 16 are located in the slab part 2 extending to the area of the beam part, as can be seen in FIGS. 1 and 2. The embodiment described above, in which the additional reinforcement components 7 comprise reinforcement elements 16 and in the latter a plurality of longitudinal reinforcement bars 15*a*–15*d*, makes possible a strong monolithic construction also in the area of a column 20 in the area of the beam part, since the longitudinal reinforcement bars 15*a*–15*d* can continue without interruption in the area of the column 20, in which case the upper reinforcement bars 15*c* and 15*d* will bear the moment in that area and thus the tensile stress on the upper surface of the composite construction. Reinforcement bars can also be overlapped in the area of a column 20 or some other extension, whereby a continuous structure is effectively obtained.

According to the invention, the contribution of the reinforcement bars 15*a*–15*d* of the additional reinforcement components 7 to the bearing capacity produced by all the steels of the composite construction, the steels thus comprising these said reinforcement bars 15*a*–15*d* and the metal sheet 9, is sufficient, and so the fire resistance requirements are fulfilled without fire protection of the metal mantle 3 on the surface of the construction. In this case, even though the reinforcing effect of the metal sheet 9 of the composite construction must be excluded in the calculation of the fire load, the additional reinforcement component 7 constitutes a sufficient and protected reinforcement proportion. It is clear that the construction may include even more longitudinal reinforcement bars than the bars 15*a*–15*d*, such as bars 18 and 19. The longitudinal reinforcement bars may also in part or entirely be prestressing steels, in which case the beam part will be either a prestressed or post-tensioned construction. It is also clear that it is possible respectively to place additional reinforcement components in the slab part 2 in order to improve the loading capacity, although they are not shown in the figure. It is clear that the slab part 2 itself may be of any type.

For simple assembling of the beam part and the slab part of the composite construction according to the invention, the slab part can be fastened to the longitudinal surfaces 5 by using studs, self-tapping screws 21, or corresponding fastening means, in which case it is not necessary to drill holes in these parts in advance. Thus the installation will be easy, since precise alignment is not necessary, and the fastening will be rapid. As shown in FIGS. 1 and 2, the bottom form 4 of the slab part 2 is preferably of corrugated sheet, such as corrugated sheet made of thin sheet and equipped with trapezoidal corrugations. In this case, fastening by using self-tapping screws 21 or studs or the like can be done simply from the bottoms of the corrugations to the longitudinal surfaces 5 of the wall form of the beam part. These fastening means 21 at the same time constitute additional anchoring, providing in the area of the longitudinal surfaces of the beam part an improved bonding to the concrete or other cast component.

As the method of manufacturing the metal mantle 3 of the beam part 1, roll forming is especially advantageous, since it keeps the manufacturing costs at an economical level. In roll forming, an embossed strip of metal sheet 9 is formed, the strip being ready for use after the roll forming and cutting. The metal mantle can, of course, also be manufactured by edging or by stamping.

We claim:

1. A composite construction which has a beam part (1) and a slab part (2) bearing thereon, the construction comprising a combination of at least the following components:

a) a metal mantle (3) of the beam part, the mantle being at the same time the casting form and being made up of an upwardly open profile which has longitudinal surfaces (5) formed by its bended edges and a portion between them;

b) additional reinforcement components (7) which, together with the metal mantle, make up the reinforcement of the composite construction; and c) a cast component (8), such as concrete, which, when set and together with the metal mantle and with the additional reinforcement components left inside the casting, makes up the composite construction, characterized in that d) the metal mantle (3) of the beam part (1) is a shaped profile, wherein one surface (10) of the mantle wall is embossed, and the thickness of this mantle wall (9) is such that said embossing will not substantially affect the surface structure of the opposite surface (11) of the wall sheet, e) the cross-sectional shape of the beam part wall form (3) in the portion between its longitudinal surfaces (5) is defined by sheet portions (12) interconnected by outwardly or inwardly oriented edges (13), corrugations (22) or welded joints (23), or by curved sheet portions (24, 25); and that f) the edges of said longitudinal surfaces (5) are oriented towards each other in order to prevent these portions (12, 24, 25) from buckling and becoming detached from the concrete.

2. A composite construction according to claim 1, characterized in that the embossed wall (9) making up the metal mantle (3) of the beam part may be of a flute- or tear-drop-patterned sheet known per se.

3. A composite construction according to claim 1 or 2, characterized in that there are at least two of the sheet portions (12*a*–*c*), that the various sheet portions (12*a*, 12*b*, 12*c*) have approximately equal widths (W), and that the angles (K) between the sheet portions are substantially greater than 90° and substantially smaller than 180°.

4. A composite construction according to claim 1 or 2, characterized in that the corrugations (22) between the sheet portions (12) are angles, curved or angular grooves, or the like, oriented towards the inside of the beam part (1).

5. A composite construction according to claim 1 or 2, characterized in that the welded joints (23) between the sheet portions are made up of butt joints of edgings oriented towards the inside of the beam part (1), the joints being welded from the outside or the inside of the beam part.

6. A composite construction according to claim 1, characterized in that the additional reinforcement components (7) comprise a plurality of reinforcement bars (15*a*–15*d*) parallel to the longitudinal direction of the beam part, the bars being tied with transverse ties (17) to form reinforcement elements (16) and that at least one set of the longitudinal reinforcement bars (15*c*, 15*d*) of the reinforcement element is located in the slab part (2) extending to the area of the beam part (1), and that the lowest longitudinal reinforcement bars (15*a*, 15*b*) are located at a level below the said longitudinal surfaces (5).

7. A composite construction according to claim 1, characterized in that the additional reinforcement components (7) are in part or entirely prestressing steels or the like.

8. A composite construction according to claim 1, characterized in that the contribution of the additional reinforcement components (7) surrounded by the cast component (8) to the total bearing capacity produced by the metal parts of the composite construction is sufficient to fulfill the fire resistance requirements, without need for fire protection of the metal mantle on the surface of the construction.

9. A composite construction according to claims 1 or 2, characterized in that in the beam part (1) in the area of the supports of the structure, such as columns (20), at least some of the additional reinforcement components (7) run without interruption or are overlappingly extended to provide a monolithic construction in order to increase resistance against the moment caused by the supporting force.

10. A composite construction according to claim 1, characterized in that the shear resistance of the construction is in the main based on the additional reinforcement (7) and the cast component (8).

11. A composite construction according to claim 1, characterized in that the bottom form (4) of the slab part (2) is fastened to the longitudinal surfaces (5) of the metal mantle (3) of the beam part by using studs, self-tapping screws (21) or corresponding means, which project from the longitudinal surfaces into the cast component of the beam to provide additional bonding between the metal mantle (3) and the cast component (8).

* * * * *